US006174382B1

(12) United States Patent
Cord et al.

(10) Patent No.: US 6,174,382 B1
(45) Date of Patent: Jan. 16, 2001

(54) LOW PRESSURE-HIGH VOLUME WATER WASHOFF APPARATUS AND PROCESS FOR CLEANING AND RECLAIMING SCREENS

(75) Inventors: Albert B. Cord; Cameron W. Cord; Ted K. Parr, all of Cincinnati; Gregory N. Jensen, Westchester, all of OH (US)

(73) Assignee: Intercontinental Chemical Corporation

( * ) Notice: Under 35 U.S.C. 154(b), the term of this patent shall be extended for 0 days.

(21) Appl. No.: 09/287,074

(22) Filed: Apr. 6, 1999

Related U.S. Application Data

(62) Division of application No. 08/908,897, filed on Aug. 8, 1997, now Pat. No. 5,915,397.

(51) Int. Cl.[7] ..... B08B 3/02

(52) U.S. Cl. ..... 134/15; 134/20

(58) Field of Search ..... 134/10, 15, 25.4, 134/25.5, 26, 61, 72, 131, 152; 101/423, 424, 425

(56) References Cited

U.S. PATENT DOCUMENTS

| | | | |
|---|---|---|---|
| 2,131,406 | | 9/1938 | Mosmieri et al. . |
| 2,682,213 | | 6/1954 | Shapiro . |
| 3,343,555 | | 9/1967 | Kasner . |
| 3,405,720 | | 10/1968 | Carlson . |
| 3,580,261 | | 5/1971 | Key . |
| 3,656,493 | | 4/1972 | Black et al. . |
| 3,760,824 | | 9/1973 | Edwards et al. . |
| 3,930,879 | | 1/1976 | Erickson et al. . |
| 4,365,383 | | 12/1982 | Bartlett . |
| 4,420,004 | | 12/1983 | Jensen . |
| 4,561,903 | | 12/1985 | Blaul . |
| 4,664,721 | | 5/1987 | Valasek . |
| 4,712,573 | | 12/1987 | Kuhl . |
| 4,717,426 | | 1/1988 | Brynildsen . |
| 4,739,780 | | 4/1988 | Czaja et al. . |
| 4,768,533 | * | 9/1988 | Hall . |
| 4,808,237 | | 2/1989 | McCormick et al. . |
| 4,826,539 | | 5/1989 | Harpold . |
| 4,865,061 | | 9/1989 | Fowler et al. . |
| 5,056,948 | | 10/1991 | Puder et al. . |
| 5,113,882 | | 5/1992 | Gileta . |
| 5,197,384 | | 3/1993 | Yawata et al. . |
| 5,206,970 | | 5/1993 | Johnson . |
| 5,220,933 | | 6/1993 | Albers . |
| 5,223,041 | | 6/1993 | Cerney . |
| 5,372,153 | | 12/1994 | Dobson . |
| 5,400,812 | | 3/1995 | MacFarlane . |
| 5,566,697 | | 10/1996 | Cord et al. . |
| 5,607,516 | * | 3/1997 | Asai . |

FOREIGN PATENT DOCUMENTS

| | | |
|---|---|---|
| 3017180 | 11/1981 | (DE) . |
| 0057966 | 8/1962 | (EP) . |
| WO90/05065 | 5/1990 | (WO) . |
| WO91/15370 | 10/1991 | (WO) . |
| WO96/24492 | 8/1996 | (WO) . |

OTHER PUBLICATIONS

Abstract, Japan patent—JP.A.58 132562, Nov. 1983.
ESC—Perfecta 'S' XP0092006526 product brochure, 4 pages.

* cited by examiner

*Primary Examiner*—Frankie L. Stinson
(74) *Attorney, Agent, or Firm*—Wood, Herron & Evans, L.L.P.

(57) ABSTRACT

A printing screen cleaning and reclaiming apparatus comprises a cleaning device defining a cleaning and reclaiming path and a plurality of low pressure-high volume water washoff stations, in series, along the path. An ink degradent, an emulsion remover, and a degreaser are each applied successively along the path, and an ink removal station, an emulsion removal station, and a degreaser removal station are positioned successively along the path to provide the low pressure-high volume water washoff. Each station is capable of delivering washoff fluid to the screen of up to 20 feet in height and any length in the range of approximately 40–400 psi, and in the range of approximately 10–250 gallons per minute for efficient and inexpensive cleaning of the screen.

9 Claims, 2 Drawing Sheets

LOW PRESSURE-HIGH VOLUME WATER WASHOFF APPARATUS AND PROCESS FOR CLEANING AND RECLAIMING SCREENS

This application is a divisional of U.S. application Ser. No. 08/908,897, filed Aug. 8, 1997 now U.S. Pat. No. 5,915,397

FIELD OF THE INVENTION

This invention relates generally to apparatuses and methods for cleaning printing ink and other materials from printing screens and frames used in screen printing, and specifically relates to low pressure-high volume water washoff for cleaning and reclaiming printing screens.

BACKGROUND OF THE INVENTION

Screen printing, also known as serigraphics, is the process of transferring an image to a substrate by the use of a printing screen through which ink is squeezed. The ink is then deposited in all places on the substrate except where the screen has been processed by a photographically applied image depicting the places where ink is not to be forced through the screen mesh. The images screen mesh is normally made of silk, plastic, or metal, and is held in place by a screen frame made of wood, plastic, or metal. The ink contains pigment or dye in an appropriate vehicle.

Screen cleaning and reclaiming requires the removal of all ink residue and emulsion (image, stencil or mould) from the screen and frame when the printing is completed. In that way, the screen may be reused for a different printing task. Methods currently utilized to clean printing screens involve spraying the screen with highly pressurized solvents and water from a nozzle or gun structure. Many such high pressure spraying techniques and apparatuses, however, require high power motors which deliver low amounts of water at very high pressures. The high power motors are expensive to purchase and maintain. Furthermore, such apparatuses generally require a long time to properly clean a screen, thus reducing efficiency and increasing the overall costs of the cleaning operation.

Several attempts have been made to develop a cleaning procedure and apparatus which efficiently and inexpensively cleans a screen. However, such attempts utilize high pressure spraying and therefore do not address the drawbacks of the prior art discussed above.

For example, U.S. Pat. Nos. 5,400,812; 5,223,041; 4,808,237; and 4,365,383 all disclose apparatuses and methods which utilize high pressure spraying at pressures of anywhere from 500 to 3,000 psi. Therefore, such devices will require expensive, high power pumps for delivering the necessary pressures.

U.S. Pat. No. 3,656,493 utilizes a single spray nozzle which is directed over one side of the screen by a control mechanism to spray a predetermined pattern. That is, each ink-removing step must be accomplished in a single station and requires monitoring to determine whether each successive step has been successful. As may be appreciated, such monitoring is time consuming and costly, and requires continuous worker supervision of the machine. Furthermore, the '493 patent does not address the problem of requiring high pressure spraying for cleaning of the screen.

Still further, U.S. Pat. No. 4,717,426 discloses a method of cleaning printing ink and printing mould wherein the ink and mould is loosened and thereafter flushed with high pressure water. U.S. Pat. No. 4,420,004 discloses an automatic printing screen cleaning apparatus which uses a high pressure water jet to remove the printing stencil. As such, existing devices have failed to address the drawbacks associated with high pressure and generally low volume spraying of screens for cleaning purposes.

Still further, many of the available apparatuses utilize single chambers which must be sequentially operated through the various different steps required to clean a printing screen. As such, screens can only be cleaned one at a time, and a cleaning process for the next successive screen cannot begin until the current screen has completed the cleaning process. As will be appreciated, the throughput for such devices is severely limited, thus reducing efficiency and increasing the overall cost of the screen cleaning process.

Additionally, various currently available screen cleaning apparatuses, as discussed above, also utilize a variety of different integrated systems which must be operably coupled together for proper screen cleaning. Such apparatuses utilize numerous adjustable or movable parts or elements that must be constantly maintained or replaced. Furthermore, as is the case with single chamber and single nozzle apparatuses, the operation of the nozzle must constantly be adjusted to provide proper coverage of the screen. The various separate systems which are coupled together for cleaning, as well as the large number of movable parts, increases the overall manufacturing and operating costs of the prior-art cleaning apparatuses.

Existing apparatuses also include elements or sections which must be constantly modified or adjusted to wash screens of different sizes. As may be appreciated, the necessity of adjusting or modifying the apparatuses for different size screens requires manual attention, and therefore, increases labor and operating costs. Additionally, the various adjustable mechanisms associated with such systems are more expensive to manufacture, thus increasing manufacturing costs.

Accordingly, and in view of the above background, there is a need for a screen cleaning and reclaiming apparatus which efficiently cleans a screen without the requirement of high water pressure for removing ink and other materials from the screen. There is also a need for a screen cleaning and reclaiming apparatus which does not require expensive, high power pumping equipment. There is also a need for an apparatus which reduces the time and manpower required for cleaning and reclaiming a screen and thus increases the throughput for the cleaning process and reduces the cost thereof. There is a need for an apparatus which is versatile, durable, reliable and which may be manufactured and subsequently used at a relatively low cost. Still further, it is desirable to have a screen cleaning and reclaiming apparatus that does not have to be repeatedly customized for different screen sizes. Further, it is desirable for such an apparatus to clean several screens in succession without requiring complete cleaning of one screen before another screen begins the cleaning process.

SUMMARY OF THE INVENTION

The above objectives and shortcomings of the prior art are addressed by the low pressure-high volume water washoff apparatus and process of the present invention. The apparatus comprises a cleaning device which defines a cleaning path wherein a screen is cleaned and reclaimed as it moves along the path. A series of low pressure-high volume water washoff stations are positioned successively along the path for cleaning and reclaiming the screen. More specifically, a washoff station for removal of ink and ink degradent is positioned along the cleaning path followed by a washoff station for emulsion removal downstream from the ink removal station, and a washoff station for degreaser removal further downstream along the cleaning path from the emulsion removal station. Each of the successive stations along the cleaning path directs a low pressure-high volume application of washoff fluid across the cleaning path to engage and wash a screen moving therealong. Preferably, water is used as a washoff fluid and is directed onto the screen from a row of nozzles positioned on either side of the path at each washoff station.

In accordance with the principles of the present invention, the nozzles deliver low pressure-high volume water washoff in the pressure range of approximately 40–400 psi with a water delivery rate of approximately 10–250 gallons per minute. Guide rails maintain the screen in a vertically upright position to intercept the low pressure streams or fans of water directed onto the screen by vertically positioned rows of nozzles at each station.

More specifically, a screen is positioned in the cleaning device on a conveyor element which moves along the cleaning path at approximately 12 feet per minute. After the screen is positioned in the screen loading area, it preferably passes by a row of nozzles which apply an ink degradent substance. Alternatively, the ink degradent substance might be manually applied to the screen. Following the application of the ink degradent substance, a hand-brushing area is provided along the cleaning path for brushing or otherwise working the ink degradent substance into the screen to loosen the ink. The screen then passes by the ink and ink removal station which washes off the ink degradent substance and ink by application of low pressure-high volume water from the opposing rows of nozzles. A low power pump, preferably around 2–10 horsepower, is coupled to the rows of nozzles at the ink removal station for removing the ink and ink degradent. In a preferred embodiment, the ink removal station delivers the water washoff at approximately 10–30 gallons per minute at a pressure of approximately 120–160 psi.

Following the ink removal step, an emulsion remover is applied such as through another row of nozzles or manually. To provide time for the emulsion remover to work on the screen, the cleaning path includes a dwell section which introduces approximately one minute of dwell time before the emulsion substance is washed off the screen. After the dwell section, the screen passes an emulsion removal station which delivers a low pressure-high volume water washoff from opposing rows of nozzles to the screen. A low power motor of less than about 50 horsepower, e.g., approximately 5 to 20 horsepower is coupled to the rows of nozzles of the emulsion removal station to deliver the low pressure-high volume water washoff. The emulsion removal station preferably delivers the water washoff at approximately 20–100 gallons per minute at a pressure of approximately 120–160 psi. Following the emulsion removal station, the cleaning path includes a hand detailing area which allows a worker to manually brush or otherwise clean and detail the screen.

After the detailing area, a degreaser to remove oily substances is applied to the screen, either manually or from a row of nozzles. Following the degreaser application, a degreaser removal station, having two opposing rows of nozzles, applies a low pressure-high volume water washoff to remove the degreaser. Preferably, an about 2–10 horsepower pump serves the degreaser removal station. The degreaser removal station delivers the water washoff at approximately 10–30 gallons per minute at approximately 120–160 psi. After the degreaser is removed, the screen is removed from the cleaning path.

A drainage channel is formed in the floor along the length of the cleaning path, generally parallel to the cleaning path. The drainage channel is approximately 12 inches wide. One section of the drainage channel services the ink removal station, and includes one or more drainage ports for coupling to a sewer line. Another section of the drainage channel services both the emulsion removal station and the degreaser removal station and includes appropriate drainage ports for coupling the channel to a sewer line. In one embodiment of the invention, the waste water from the degreaser removal station might be recycled and used as makeup water for the emulsion removal station. Accordingly, a drain pit may be coupled to the drainage channel proximate the emulsion removal station for pumping water to the emulsion removal station.

In accordance with the principles of the present invention, a low pressure-high volume water washoff apparatus of the invention reduces the number of man-minutes used to clean and reclaim a screen. It also reduces the need for high pressure pumps which are expensive to buy and maintain. It is estimated that the invention provides an approximately 80% reduction in man-minutes, and that a 400% increase in cleaning capacity from those provided by current apparatuses will be realized.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
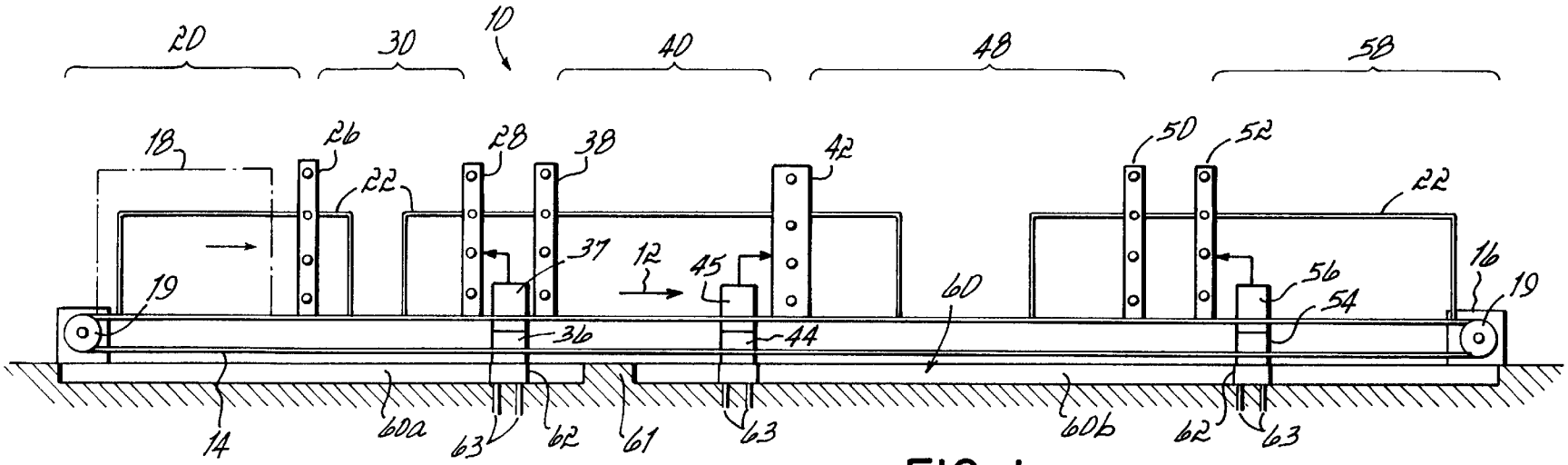
FIG. 1 is a schematic cross-sectional view of the cleaning apparatus of the present invention illustrating the in-line washoff stations along the cleaning path.

The low pressure-high volume water washoff apparatus 10 of the present invention defines a cleaning path therethrough in the direction of reference arrow 12 for cleaning and reclaiming a screen with low pressure-high volume water washoff of various chemicals utilized in the screen cleaning process. As shown in the Figures, the apparatus 10 includes a conveyor system with a conveyor element, such as a continuous conveyor belt 14, which travels along the length of the cleaning apparatus to move the screen therethrough along cleaning path 12. The conveyor system further includes a drive motor 16 or other suitable drive mechanism for moving conveyor belt 14 and a screen 18 placed thereon and rollers or guides 19 for containing belt 14. Preferably, the apparatus is configured for washing screens which are from about 1 foot to about 20 feet high, although screens will normally be approximately 8–10 feet high. Screen 18 is loaded in a screen loading area designated by reference numeral 20, and is held in a vertical position by a suitable guide rail 22. The conveyor belt 14 preferably moves at a rate of about 12 feet per minute so that once the screen is loaded in the loading area 20, the screen will progress along cleaning path 12 to be cleaned and reclaimed.

An ink degradent substance is first applied to the screen 18 at a station 26 which preferably includes at least one row of nozzles operably coupled to a supply of the ink degradent substance (not shown) such as those known solvents and liquids described in U.S. Pat. No. 4,664,721, available from Intercontinental Chemical Corporation of Cincinnati, Ohio, and such disclosure is incorporated herein in its entirety by reference. Alternatively, the ink degradent might be applied manually, such as with a brush or hand sprayer, such as a sprayer gun. Station 26 is approximately one foot long along path 12, whereas the screen loading area is approximately 12 feet long. An area approximately 8 feet long is provided between an ink removal station 28 and station 26 along cleaning path 12, as designated by reference numeral 30. Area 30 is a hand-brushing area for brushing the screen on the front and back sides thereof to work the ink degradent into the screen 18. The ink removal station 28 then provides a low pressure-high volume water washoff of the screen 18 to remove the ink degradent substance.

Figure 3:
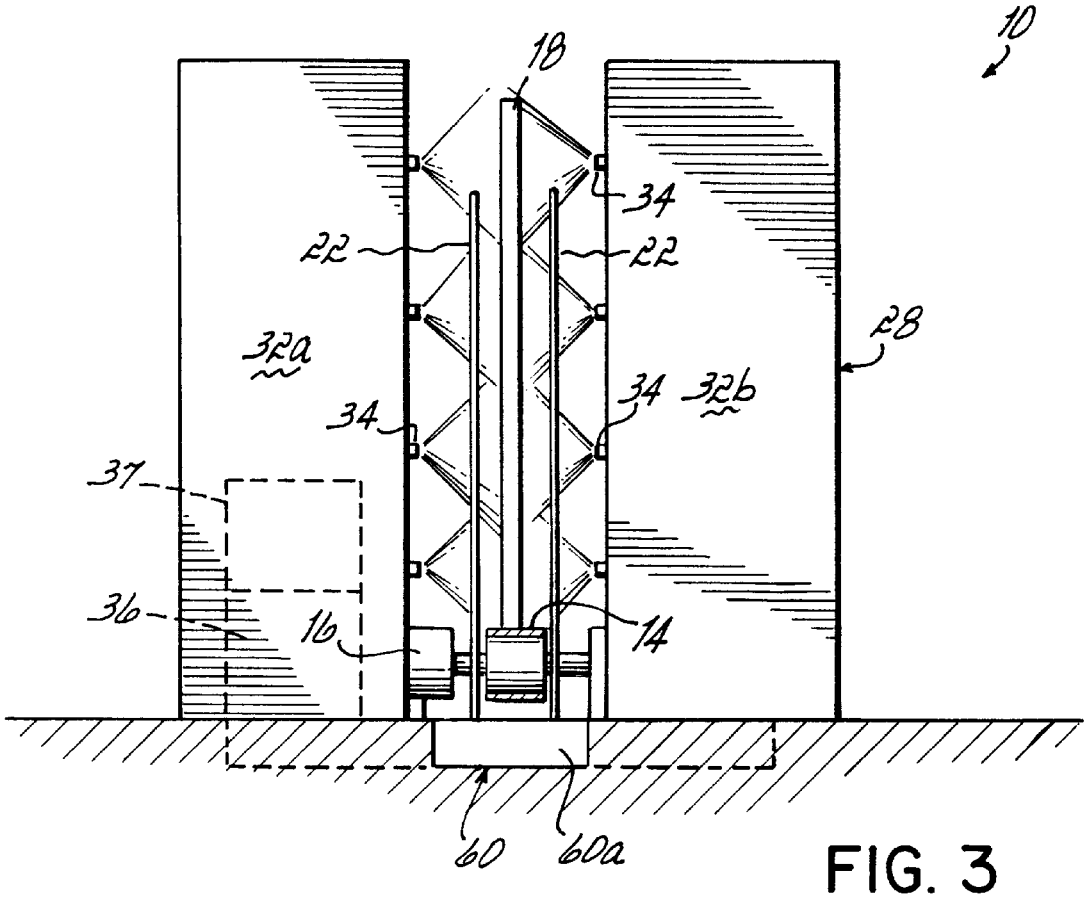
FIG. 3 is a schematic cross-sectional view along lines 3—3 of one of the washoff stations of the inventive apparatus.

Referring to FIG. 3, ink removal station 28 includes two vertically oriented rows of nozzles 32*a* and 32*b*. The rows of nozzles are positioned on either side of the cleaning path 12 and conveyor belt 14 to oppose each other and thus spray both sides of the screen. The individual nozzles 34 of each row provide a fan-shaped spray pattern as illustrated, and are similar, for example, to those nozzles utilized in co-pending application U.S. Ser. No. 08/384,737, which is incorporated herein by reference in its entirety. Preferably, the guide rails 22 are provided on either side of the screen 18, to keep the screen in a vertical position as it progresses along the cleaning path 12 and through the various low pressure-high volume washoff stations of the invention.

In accordance with the principles of the present invention, the rows of nozzles 32*a*, 32*b* are coupled to a low power pump 36, which is less than approximately 10 horsepower (hp), and is preferably around 5 hp. A filter 37 may also be coupled to pump 36 to filter the washoff fluid. The pump should be capable of delivering a washoff fluid at a rate of approximately 10–250 gallons per minute at a pressure of approximately 40–400 psi. In a preferred embodiment of the invention, water is used as the washoff fluid to remove the ink degradent, although another suitable washoff fluid might be utilized. Preferably, pump 36 will provide approximately 10–30 gallons per minute to screen 18 under pressure of approximately 120–160 psi.

Referring again to FIG. 3, pump 36 is appropriately coupled to the rows of nozzles 32*a* and 32*b* to provide simultaneous spraying of screen 18 as it passes through station 28. The individual nozzles 34 are spaced vertically along the rows so that the fan patterns effectively overlap, as illustrated in FIG. 3, to provide complete washoff coverage of the screen 18. The rows 32*a*, 32*b* may be anywhere from approximately 1 foot to 20 feet high, and preferably are dimensioned to clean a 8–10 foot screen. The rows 32*a*, 32*b* thus effectively form opposing towers of nozzles at the removal station 28. The towers of station 28 only occupy about one foot of the overall length of the cleaning path.

Following ink removal station 28, an emulsion remover is applied at station 38, which is downstream along cleaning path 12, approximately 3 feet from station 28. The emulsion remover may be applied through a row of nozzles, such as nozzles similar to those shown in rows 32*a* and 32*b* utilized with station 28. Alternatively, the emulsion remover might be manually applied, such as with a hand sprayer, or other suitable apparatus. Preferably, the emulsion remover station 38 is also approximately one foot long along the cleaning path 12.

Following station 38, and successively downstream in the cleaning path 12, is an approximately 12 foot long dwell section 40 which preferably introduces a one minute dwell time so that the emulsion remover can act on the screen. A suitable emulsion remover is described in U.S. Pat. No. 4,664,721, available from Intercontinental Chemical Corporation, and such disclosure is incorporated herein in its entirety by reference. After the emulsion remover has had time to work, screen 18 is passed through an emulsion removal station 42 which is constructed similarly to station 28 as illustrated in FIG. 3, and has opposing vertical rows of nozzles which are serviced by an appropriate pump 44 and filter 45 for delivering washoff fluid to the screen to remove the emulsion substance. Preferably, the washoff fluid is water and is delivered to the screen at about 20–100 gallons per minute at a pressure of approximately 120–160 psi. Pump 44 is also a low power pump which is rated below 20 hp and preferably is only approximately 15 hp to deliver a low pressure-high volume water washoff to screen 18 to remove the emulsion. Pump 44 and station 42 are capable of delivering a water volume of approximately 10–250 gallons per minute at a pressure of approximately 40–400 psi, although 20–100 gallons per minute at a pressure of 120–160 psi has been found suitable for the emulsion removal step.

In the preferred embodiment, station 42 will require approximately two feet of length along the cleaning path 12 for providing the suitable volume of water for removing the emulsion. After the emulsion has been removed by the emulsion removal station 42, apparatus 10 includes a hand-detailing area approximately 17 feet long, indicated by reference numeral 48, to remove any remaining emulsion substance that is still on the screen. The hand-detailing area 48 allows the worker to brush or otherwise clean and detail the screen 18 so that it is ready to receive a degreaser substance, as discussed further hereinbelow.

Further downstream from the emulsion removal station 42 is a station 50 for applying a degreaser substance, as described in U.S. Pat. No. 4,664,721, available from Intercontinental Chemical Corporation, and such disclosure is incorporated herein in its entirety by reference. The degreaser substance may be applied by a row of nozzles similar to the rows of nozzles illustrated in FIG. 3, or may be applied by a hand-spraying apparatus or other suitable apparatus such as those used to apply the ink degradent and emulsion, as discussed above. After the degreaser substance has been applied and further downstream from station 50, a degreaser removal station 52, is utilized to provide a low pressure-high volume washoff to remove the degreaser. The washoff is preferably performed using water which may be delivered at approximately 10–250 gallons per minute at a pressure of approximately 40–400 psi. In a preferred embodiment, the water washoff is delivered at approximately 10–30 gallons per minute at 120–160 psi. Accordingly, station 52 includes a pump 54 and a filter 56 for delivering the water washoff. Degreaser removal station 52 is formed similar to station 28, as illustrated in FIG. 3 and includes opposing rows of nozzles which are arranged to extend vertically to form opposing towers of nozzles to deliver the water washoff. Each of the application station 50 and degreaser removal station 52 are preferably approximately one foot long along the cleaning path 12 with three feet therebetween.

After the degreaser has been applied and washed off, the screen may be removed from apparatus 10. Accordingly, a screen removal area 58, approximately 15 feet long, is provided. In accordance with one aspect of the present invention, screens may be continually loaded in the loading area 20 while previous screens are at different stages of ink removal, emulsion removal, and degreaser removal. In that way, apparatus 10 provides for successive and continuous cleaning of screens without requiring one screen to be completely cleaned before the next screen is loaded in the apparatus. Accordingly, the low pressure-high volume water washoff apparatus of the present invention provides for a substantial increase in productivity. It is estimated that an increase in productivity of approximately 400% may be achieved. Furthermore, the low pressure-high volume delivery of water during the washoff stages of the present invention substantially reduces the number of man-minutes required to clean and reclaim a screen. It is estimated that an 80% reduction in man-minutes can be achieved. Still further, the need for high pressure pumps, which are expensive to buy and maintain, is eliminated. For example, the high pressure, low volume technique of the prior art would require pumps of a power range of approximately 150–200 hp which are capable of delivering 1–60 gallons of washoff fluid per minute at 500–3000 psi. In a preferred embodiment of the invention, three motors having a cumulative power requirement of approximately 25 hp are all that is necessary to provide the low pressure-high volume washoff of the present invention. This results in a substantial cost saving both from the initial purchase of the pumps and maintenance or replacement thereof. Utility costs to run the pumps are also reduced.

Figure 2:
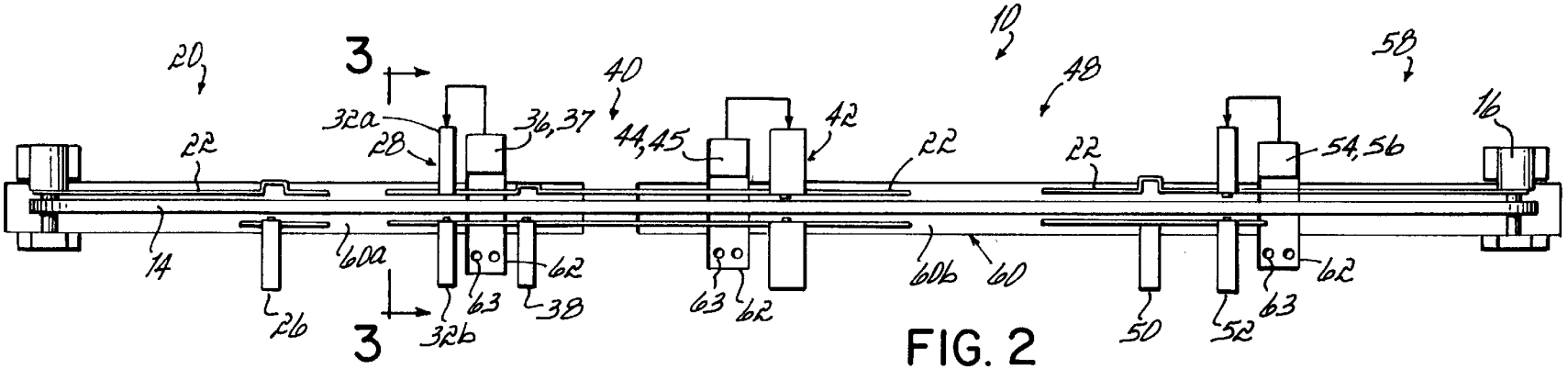
FIG. 2 is a schematic top view of the inventive apparatus.

Referring to FIGS. 1 and 2, apparatus 10 includes a drainage channel 60 formed beneath conveyor belt 14, generally parallel to the conveyor belt and cleaning path 12. Drainage is approximately 12 inches wide and channel 60 captures the washoff fluid applied to the screen during the cleaning and reclaiming process. Channel 60 is shown relatively wider in the Figures for illustrative purposes. The drainage channel 60 is divided into sections 60*a* and 60*b* by an appropriate dividing wall 61. Drainage channel section 60*a* captures the washoff fluid from ink removal station 28 to direct it to a sewer line. Accordingly, the drainage channel section 60*a* includes a drainage pit 62 which includes one or more sewer line ports 63, which are coupled to an appropriate sewer line (not shown).

Drainage channel 60*b*, on the other hand, captures the washoff fluid from the emulsion removal station 42 and the degreaser removal station 52. Accordingly, channel section 60*b* also includes a drainage pit 62 which includes one or more sewer line ports 63 as illustrated in FIG. 2. In one embodiment of the invention, the washoff fluid captured from the degreaser removal station 52 is recycled and used as make up water for the emulsion removal station 42. Accordingly, pump 44 and filter 45 are appropriately coupled to the drainage pit 62 and drainage channel 60*b* for recycling at least a portion of the water from station 52 back into use in station 42.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A method for cleaning ink from and reclaiming a printing screen having an image of emulsion thereon moving along a cleaning and reclaiming path comprising:

moving the ink bearing printing screen along the cleaning and reclaiming path;

applying an ink detergent to the screen;

removing the ink and ink degradent from the screen with a low pressure and high volume fluid washoff which delivers washoff fluid to the screen in the range of approximately 40 to 400 psi and in the range of approximately 10 to 250 gallons per minute;

applying an emulsion remover to the screen;

removing the emulsion and emulsion remover downstream in said path from the ink and ink degradent removal, with a low pressure and high volume fluid washoff which delivers washoff fluid to the screen in the range of approximately 40 to 400 psi and in the range of approximately 10 to 250 gallons per minute;

whereby a screen is efficiently and inexpensively cleaned and reclaimed for future use.

2. The method of claim 1 further comprising:

applying a degreaser to the screen;

removing the degreaser and oily residue downstream in said path from the emulsion removal, with a low pressure and high volume fluid washoff which delivers washoff fluid to the screen in the range of approximately 40 to 400 psi and in the range of approximately 10 to 250 gallons per minute.

3. The apparatus of claim 2 further comprising capturing washoff fluid delivered in said degreaser removal step and using it for said emulsion removal step.

4. The method of claim 2 further comprising hand detailing the screen between said emulsion removal step and said degreaser removal step for further cleaning the screen.

5. The method of claim 1 wherein the washoff fluid is water.

6. The method of claim 1 further comprising delivering at least one of said high volume and low pressure washoffs through a row of nozzles operable for spraying washoff fluid into the cleaning path to clean the screen.

7. The apparatus of claim 1 further comprising collecting used washoff fluid in a drainage channel positioned generally beneath said path and directing the used fluid to a sewer line.

8. The method of claim 7 wherein used washoff fluid from the ink degradent removal step is captured separately from used washoff fluid from the emulsion removal step.

9. The method of claim 1 further comprising introducing a dwell delay between said ink degradent removal step and said emulsion removal step for allowing the emulsion substance time to act on the screen.

* * * * *